US008493427B2

(12) United States Patent
Oki et al.

(10) Patent No.: US 8,493,427 B2
(45) Date of Patent: Jul. 23, 2013

(54) OPTICAL SCANNING APPARATUS AND IMAGE FORMING APPARATUS PROVIDED WITH THE SAME

(75) Inventors: Tsuneo Oki, Osaka (JP); Yoshinobu Yoneima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 218 days.

(21) Appl. No.: 12/976,151

(22) Filed: Dec. 22, 2010

(65) Prior Publication Data

US 2011/0158694 A1 Jun. 30, 2011

(30) Foreign Application Priority Data

Dec. 28, 2009 (JP) ..... 2009-296968
Jun. 4, 2010 (JP) ..... 2010-128558

(51) Int. Cl.
*B41J 2/435* (2006.01)
*B41J 27/00* (2006.01)

(52) U.S. Cl.
USPC ..... 347/263; 347/262; 347/261; 347/260; 347/259

(58) Field of Classification Search
USPC ..... 347/242, 257, 259–263
See application file for complete search history.

(56) References Cited

U.S. PATENT DOCUMENTS

| | | | | |
|---|---|---|---|---|
| 4,866,324 | A * | 9/1989 | Yuzawa et al. | 310/268 |
| 2003/0185584 | A1* | 10/2003 | Hirose et al. | 399/92 |
| 2010/0220374 | A1* | 9/2010 | Sumi et al. | 359/216.1 |
| 2011/0129259 | A1* | 6/2011 | Nakano et al. | 399/221 |

FOREIGN PATENT DOCUMENTS

| | | |
|---|---|---|
| JP | 2002-148542 | 5/2002 |
| JP | 2008-268698 | 11/2008 |

* cited by examiner

*Primary Examiner* — Stephen Meier
*Assistant Examiner* — Sarah Al Hashimi
(74) *Attorney, Agent, or Firm* — Dilworth & Barrese, LLP.

(57) ABSTRACT

The present invention is an optical scanning apparatus that is positioned and fixed to a metal frame of an image forming apparatus, in which a rotating polygon mirror being a deflection means and a drive motor rotationally driving the rotating polygon mirror are accommodated inside a housing made of resin. In the present invention, a bearing of the drive motor and a positioning member provided upright to the metal frame are inserted into and fitted with each other from opposite directions in a positioning boss formed in the housing, and the bearing is in contact with the positioning member.

11 Claims, 10 Drawing Sheets

OPTICAL SCANNING APPARATUS AND IMAGE FORMING APPARATUS PROVIDED WITH THE SAME

This application is based on and claims the benefit of priority from Japanese Patent Application Nos. 2009-296968 and 2010-128558, respectively filed on 28 Dec. 2009 and 4 Jun. 2010, the contents of which are incorporated herein by reference.

BACKGROUND OF THE INVENTION

1. Field of the Invention

The present invention relates to an optical scanning apparatus for optically scanning a surface to be scanned, and an image forming apparatus such as a copy machine and a printer provided with the optical scanning apparatus.

2. Related Art

In an image forming apparatus such as a copy machine and a printer, a surface of an image carrying body is uniformly charged by way of a charging device, and the image carrying body is scanned by an optical scanning apparatus. As a result, an electrostatic latent image corresponding to image information is formed on the surface of the image carrying body. Thereafter, the electrostatic latent image is developed by way of a developing device using a toner as a developer, and is visualized (developed) as a toner image. The toner image is transferred onto paper by way of a transfer device, and then the paper is heated and pressurized by way of a fixing device, a result of which the toner image is fixed onto the paper. The paper with the toner image fixed thereon is ejected outside the apparatus, thereby terminating a series of image forming operations.

Incidentally, an optical scanning apparatus, which optically scans an image carrying body and forms an electrostatic latent image on a surface thereof, is positioned and fixed to a metal frame of an image forming apparatus. Moreover, the optical scanning apparatus is configured by accommodating optical components such as various lenses and mirrors, a polygon mirror (rotating polygon mirror) as a deflection means, a polygon motor that rotationally drives the polygon mirror, etc. in a housing made of resin.

When the number of sheets of paper to be printed is increased in the image forming apparatus provided with the optical scanning apparatus, the ambient temperature inside the housing is increased due to heat generated by revolution of the polygon motor, and thermal deformation occurs in the polygon mirror. This adversely affects a focal length and the like, thereby making it impossible to perform optical scanning with high precision. This brings about problems such as deterioration of image quality.

Accordingly, for example, Japanese Unexamined Patent Application, Publication No. 2008-268698 suggests a configuration including a blower that generates an air flow, and an air-duct that guides the air flow from the blower, inside a housing of an optical scanning apparatus.

SUMMARY OF THE INVENTION

However, in the configuration suggested in Japanese Unexamined Patent Application, Publication No. 2008-268698, it is required to provide a blower and an air-duct inside a housing. Therefore, this configuration has problems that the size of an optical scanning apparatus is increased, the number of parts is increased, and the cost is increased.

An object of the present invention is to provide an optical scanning apparatus that is capable of suppressing increase of an ambient temperature in a housing and of preventing deterioration of image quality due to thermal deformation or the like, and to provide an image forming apparatus including this optical scanning apparatus.

A first aspect of the present invention is an optical scanning apparatus that is positioned and fixed to a metal frame of an image forming apparatus, and the optical scanning apparatus includes: a housing; a rotating polygon mirror that is a deflection means accommodated inside the housing; a drive motor, which is accommodated inside the housing, and which rotationally drives the rotating polygon mirror; and a positioning boss that is formed in the housing, in which a bearing of the drive motor and a positioning member provided upright to the metal frame are inserted into and fitted with each other from opposite directions in the positioning boss, and the bearing is in contact with the positioning member.

According to the first aspect, heat generated in the drive motor is conducted from the bearing of the drive motor to the positioning member, and is radiated to the outside of the housing. Therefore, according to the first aspect, the increase of the ambient temperature inside the housing can be suppressed with a simple configuration using existing parts. Moreover, it is possible to prevent deterioration of image quality accompanying deviation or the like of a focal length due to thermal deformation of the rotating polygon mirror without causing upsizing or cost increase of the optical scanning apparatus.

In addition, it is preferable that the positioning member is a metal positioning pin.

Furthermore, it is preferable that the bearing of the drive motor is in contact with the positioning pin via a buffer material having high thermal conductivity.

According to the present invention, heat generated in the drive motor is conducted through the buffer material having high heat conduction and the metal positioning pin, and is radiated to the outside of the housing. Therefore, increase of an ambient temperature inside the housing is suppressed, and fluctuation of the height dimension of the positioning pin is absorbed by elastic deformation of the buffer material.

Moreover, an image forming apparatus of the present invention is characterized by including the optical scanning apparatus.

According to the present invention, increase of an ambient temperature inside the housing of the optical scanning apparatus is suppressed, and optical scanning for an image carrying body is performed with high precision. Therefore, high quality images can be stably obtained.

In addition, the optical scanning apparatus of the second aspect of the present invention is characterized by including: a housing; a drive unit attached inside the housing, the drive unit including a rotating polygon mirror that deflects and scans scanning light in a predetermined direction from a light source, a drive motor that rotationally drives the rotating polygon mirror via a motor shaft, and a circuit board; a holding member that holds entirety of the drive unit; and a plate-like buffer material with high thermal conductivity, which is in contact with both of the holding member and an image forming apparatus main body, and which supports entirety of the holding member.

According to the second aspect, the drive unit is provided inside the housing, and the drive unit has the polygon mirror, the drive motor, and the circuit board.

The rotating polygon mirror is driven by revolution of a motor shaft of the drive motor. Vibration occurs with the revolution of the motor shaft. Since the vibration is transmitted to the housing, there is a concern that a position of writing an image by scanning light is not stabilized (generation of a jitter image).

However, in the second aspect, the holding member holds the entirety of the drive unit including the rotating polygon mirror, the drive motor and the circuit board; in other words, the holding member has a wide area that can support the total weight of the drive unit. The plate-like buffer material supports the entirety of the holding member; in other words, the plate-like buffer material has a wide area that can support the total weight of the holding member including the weight of the drive unit as well.

Therefore, as compared to a conventional case in which a support portion is provided between slits, and an optical system is placed in the support portion to secure strength of the housing, according to the second aspect, vibration of the housing can be immediately suppressed, and image deterioration due to a jitter image can be prevented.

Furthermore, since the buffer material having a large area has high thermal conductivity, heat generated in the drive unit can be instantly released to the image forming apparatus main body, i.e. to the outside of the housing. Therefore, it is not necessary as in conventional cases to select a material (coefficient of thermal expansion) of a housing, which is close to a coefficient of thermal expansion of an image forming apparatus main body. Moreover, thermal deformation of the housing can be securely avoided, and image deterioration due to generation of color deviation in an image can also be prevented, as compared to a case of cooling the housing with merely a cooling air from a blower.

In brief, according to the second aspect, the plate-like buffer material having high thermal conductivity is disposed between the holding member, which maintains the posture of the drive unit, and the image forming apparatus main body. Therefore, both of a jitter image and an image with colour deviation can be securely prevented from being generated.

In addition, it is preferable that the holding member includes a radiating fin, which extends from the drive unit toward the buffer material, and which is in contact with air outside the housing.

According to the present invention, the holding member includes a radiating fin, and the radiating fin can assist a heat radiation function by way of the buffer material. Therefore, the ambient temperature inside the housing can be decreased even more effectively.

Furthermore, it is preferable that the housing includes a plate-like partition portion that partitions an inside of a surrounding wall thereof into a first level and a second level, the partition portion having: an aperture that communicates the first level and the second level to form a light path; and an opening for disposing the rotating polygon mirror on the first level, in which an optical system can be disposed such that scanning light from the rotating polygon mirror is deflected from the first level to the aperture, and the holding member supports a face facing the second level in the partition portions to close the opening, and disposes the rotating polygon mirror on the first level in this state.

According to the present invention, the housing has a structure like the shape of the letter H in a cross sectional view, and it is possible to realize reduction of the size and height dimension of the optical scanning apparatus. In addition, the inside of the housing is partitioned into the first level and the second level by way of the plate-like partition portion, and the rotating polygon mirror placed in the holding member protrudes from the opening, and is disposed on the first level. The scanning light from the rotating polygon mirror travels toward the second level via the optical system of the first level and the aperture formed in the partition portion.

Here, in a case in which the partition portion of the housing includes the slits and the opening, the strength of the housing is decreased as compared to a case in which the partition portion does not include the slits and the opening. However, the holding member supports a face facing the second level in the partition portion. In other words, the holding member supports the total weight of the housing including the optical system, in addition to the total weight of the drive unit. By this, the strength of the housing is improved, and vibration transmitted from the drive unit to the housing can also be suppressed.

Moreover, an image forming apparatus of the present invention is an image forming apparatus including the optical scanning apparatus, in which the scanning light deflected and scanned by way of the rotating polygon mirror is irradiated on a surface of an image carrying body to form an electrostatic latent image, and a toner image, which was developed from the electrostatic latent image with a toner, is transferred onto a recording material.

According to the present invention, image deterioration due to a jitter image and an image with colour deviation can be prevented, and satisfactory image quality can be obtained. Therefore, the reliability of the image forming apparatus is improved.

DETAILED DESCRIPTION OF THE INVENTION

Embodiments of the present invention are described hereinafter with reference to the attached drawings.

[Image Forming Apparatus]

Figure 1:
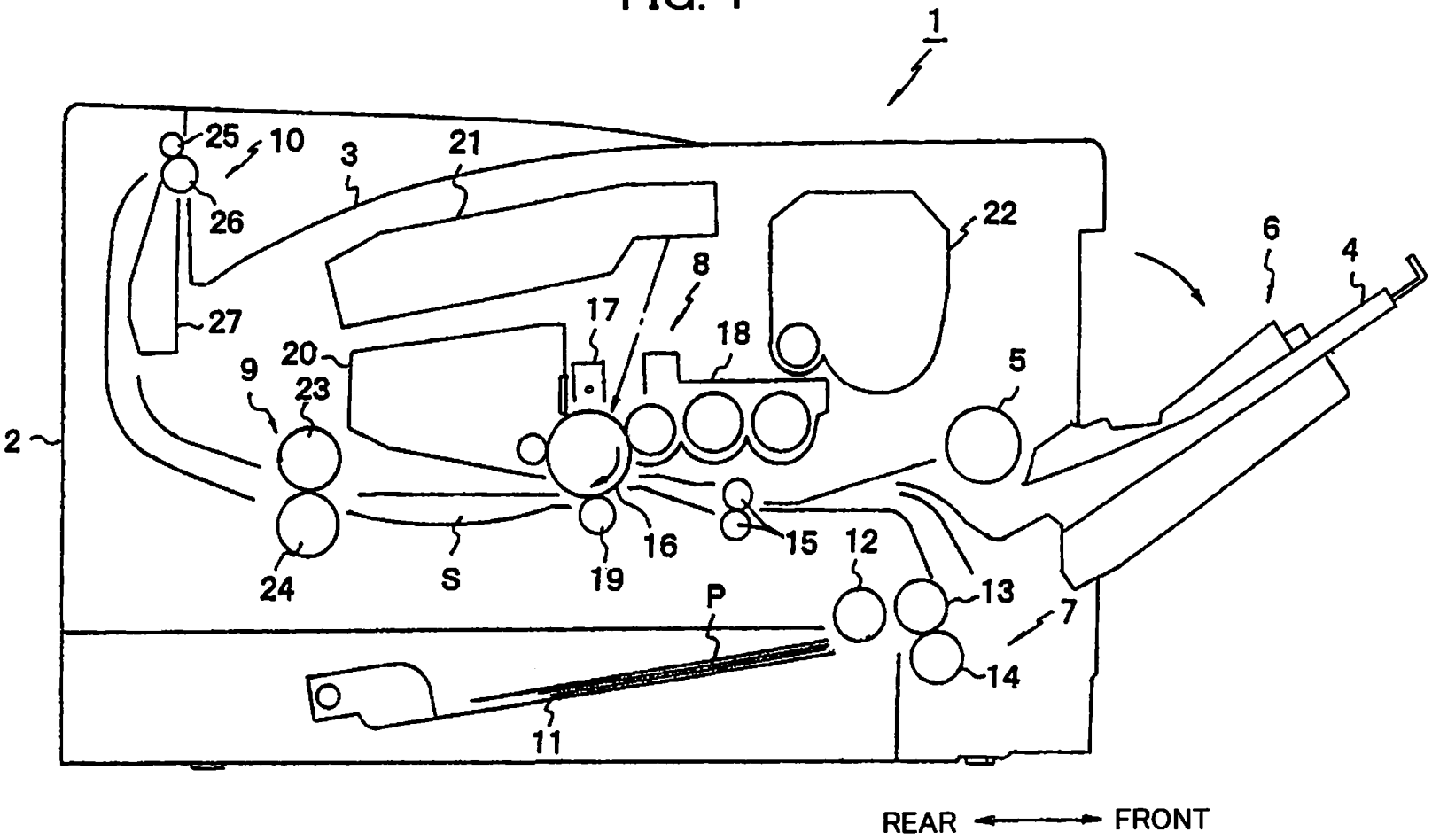
FIG. 1 is a cross-sectional side view of an image forming apparatus (laser printer) according to a first embodiment of the present invention.

FIG. 1 is a cross-sectional side view of a laser printer as a first embodiment of an image forming apparatus according to a first aspect of the present invention. In a laser printer 1 as illustrated, an ejected paper tray 3 with an inclined concave shape is provided in a central portion of a top surface of a rectangular box-shaped printer main body (housing) 2. In addition, an openable and closable manual feed tray 4 is provided in an upper portion of a front face (a right side of FIG. 1 is the front) of the printer main body 2. The manual feed tray 4 and a feed roller 5 for manual feeding configure a manual paper feed unit 6. The feed roller 5 is rotatably provided behind the manual feed tray 4 and inside the printer main body 2.

In this way, the laser printer 1 conveys paper P being a recording material along a paper path S that is provided inside the printer main body 2. In addition, based upon image data transmitted from a computer terminal or the like (not shown), the laser printer 1 forms an image on the paper P thus conveyed. The paper path S extends toward the ejected paper tray 3 in a substantially L-shape in a side face view.

Moreover, the laser printer 1 includes: a cassette paper feed unit 7 that is provided in a lower portion of the printer main body 2; an image forming unit 8 that is provided in a substantially central portion inside the printer main body 2 above the cassette paper feed unit 7; a fixing device 9 that is disposed behind the image forming unit 8; and a concave paper ejection unit 10 that is provided on a top surface of the printer main body 2 above the fixing device 9.

The cassette paper feed unit 7 has a paper feed cassette 11 that is a rectangular tray of which top surface is opened, in which a plurality of sheets of paper P are stacked and accommodated. The cassette paper feed unit 7 includes: a pick-up roller 12 that picks up paper P sheet by sheet inside the paper feed cassette 11; and a feeding roller 13 and a retarding roller 14 that separate the paper P thus picked up and feed the paper P to the paper path S sheet by sheet. The paper path S is provided with a pair of resisting rollers 15 that temporarily retains the paper P and supplies the paper P to the image forming unit 8 at predetermined timing.

The image forming unit 8 forms an image, in accordance with image data, on a sheet of paper P that is fed sheet by sheet from the manual paper feed unit 6 or the cassette paper feed unit 7. The image forming unit 8 includes: a photoreceptor drum 16 as an image carrying body disposed rotatably in a substantially central portion inside the printer main body 2; a charging device 17; a developing device 18 that is a developing means; a transfer roller 19 that is a transferring means; a cleaning device 20; an optical scanning apparatus (laser scanner unit) 21 according to the present invention disposed above these; a toner hopper 22 that stores a toner for refilling; etc. The charging device 17, the developing device 18, the transfer roller 19 and the cleaning device 20 are disposed around the photoreceptor drum 16.

In addition, the fixing device 9 fixes a toner image, which was transferred to paper P in the image forming unit 8, to the paper P. The fixing device 9 includes a fixing roller 23 and a pressure roller 24 that are in pressed contact with each other to revolve. It should be noted that a heating means such as a heater is built into the fixing roller 23. The pressure roller 24 is pressed against the fixing roller 23 at predetermined pressure by way of a biasing means such as a spring. A fixing nip is formed between the fixing roller 23 and the pressure roller 24.

Furthermore, the paper ejection unit 10 ejects the paper P, on which a toner image was fixed in the fixing device 9, to the outside of the printer main body 2. The paper ejection unit 10 includes: a vertical pair of paper ejection rollers 25 and 26 that are provided at the end of the paper path S; a plurality of conveying guide ribs 27 shaped like longitudinal ribs; and the ejected paper tray 3 for stacking paper P ejected to the outside of the printer main body 2. The conveying guide ribs 27 guide the paper P, which is conveyed along the paper path S from the fixing device 9, to the pair of paper ejection rollers 25 and 26.

Next, a description is provided for image forming operations of the laser printer 1 of the first embodiment having the aforementioned configuration.

For example, when a signal to start printing is transmitted from a terminal such as a personal computer to the laser printer 1, in the image forming unit 8, the photoreceptor drum 16 is rotationally driven at a predetermined processing speed in a direction of an arrow shown in FIG. 1 (clockwise direction) by way of a driving means (not shown). A surface of the photoreceptor drum 16 is uniformly charged at a predetermined electric potential by way of the charging device 17. In addition, in accordance with image data transmitted from the terminal, a laser beam L is output from an optical scanning apparatus 21, and is irradiated on the photoreceptor drum 16. As a result, an electrostatic latent image corresponding to the image data is formed on the photoreceptor drum 16. Thereafter, the electrostatic latent image formed on the photoreceptor drum 16 is developed by using a toner being a developer by way of the developing device 18, and is visualized as a toner image.

Incidentally, when feeding paper from a cassette is performed, paper P accommodated inside the paper feed cassette 11 of the cassette paper feed unit 7 is picked up sheet by sheet from the top paper by way of the pick-up roller 12. The paper P is then separated sheet by sheet by the feeding roller 13 and the retarding roller 14, and is conveyed to the pair of resisting rollers 15. In addition, in the pair of resisting rollers 15, the paper P is temporarily held in a stand-by state, and is then supplied to the image forming unit 8 at predetermined timing that is synchronized with the toner image on the photoreceptor drum 16.

In the image forming unit 8, the paper P, which was supplied to a transfer nip between the photoreceptor drum 16 and the transfer roller 19, is conveyed while being pressed against the photoreceptor drum 16 by way of the transfer roller 19. By this, the toner image on the photoreceptor drum 16 is transferred onto the surface (transfer surface) of the paper P. The paper P with the toner image transferred thereon is then conveyed to the fixing device 9, and is heated and pressurized in the process of being conveyed while being interposed by the fixing nip between the fixing roller 23 and the pressure roller 24 in the fixing device 9. As a result, the toner image is fixed on the paper P.

It should be noted that, after the toner image is transferred onto the paper P, a toner (residual toner) remaining on the surface of the photoreceptor drum 16 is removed by the cleaning device 20. The photoreceptor drum 16 of which surface has been cleaned is ready for a subsequent image forming operation.

In this way, the paper P with a toner image fixed on its surface by way of the fixing device 9 is conveyed upstream through the paper path S and toward the paper ejection unit 10, and is guided to the pair of paper ejection rollers 25 and 26 along the conveying guide ribs 27. The paper P is then conveyed to the outside of the printer main body 2 in a state of being interposed by the pair of paper ejection rollers 25 and 26, and is stacked on the ejected paper tray 3 provided on the upper portion of the printer main body 2. The series of image forming operations are terminated by this.

It should be noted that, in a case in which a user manually feeds paper, the paper P stacked on the manual feed tray 4 of the manual paper feed unit 6 is supplied to the pair of resisting rollers 15 by way of the feed roller 5 for manual feeding. Thereafter, an image is formed on paper P through an image forming process that is similar to the process described above. The paper P with the image formed thereon is stacked on the ejected paper tray 3 outside the printer main body 2.

[Optical Scanning Apparatus]

Next, the optical scanning apparatus 21 according to the first embodiment of the present invention is described with reference to FIGS. 2 to 5.

Figure 2:
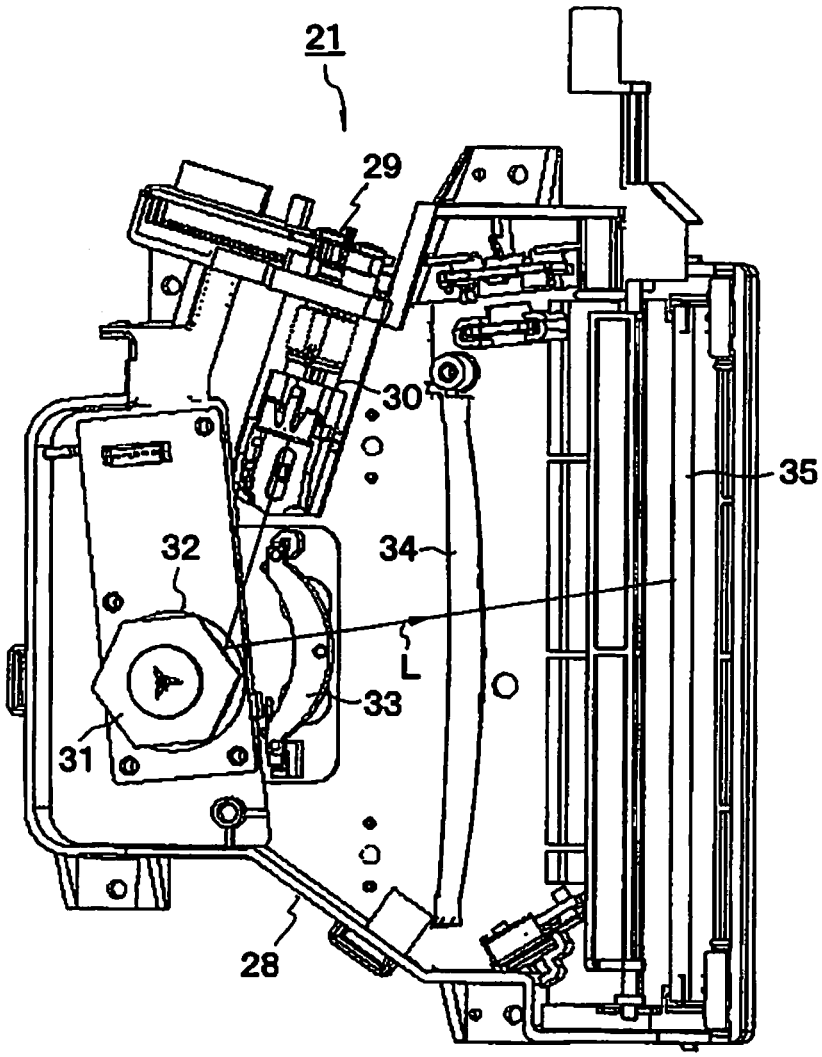
FIG. 2 is a plan view showing an optical scanning apparatus according to the first embodiment, in a state in which a cover thereof is removed.
Figure 3:
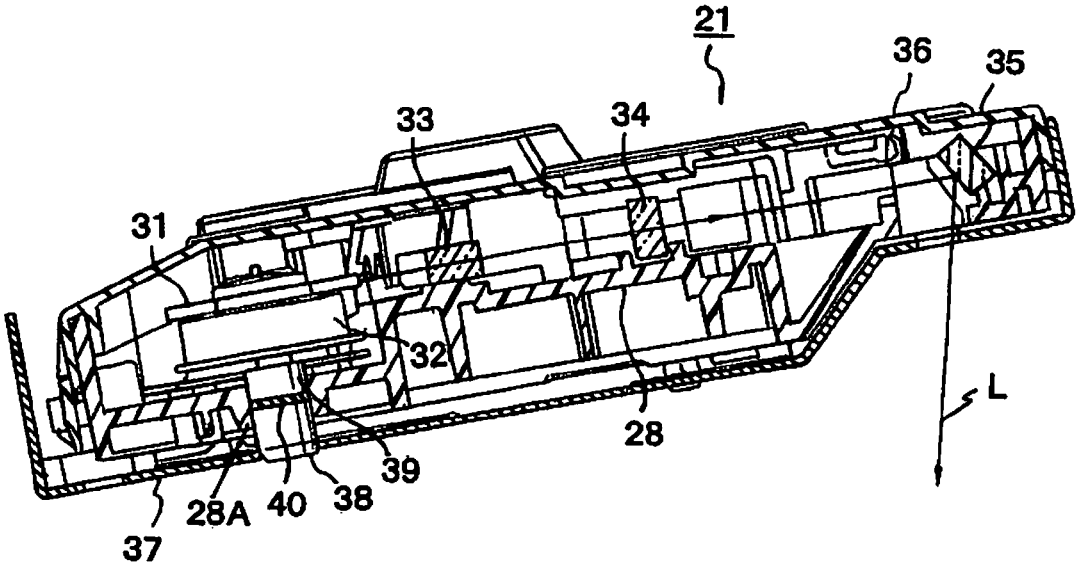
FIG. 3 is a cross-sectional side view of the optical scanning apparatus according to the first embodiment.
Figure 4:
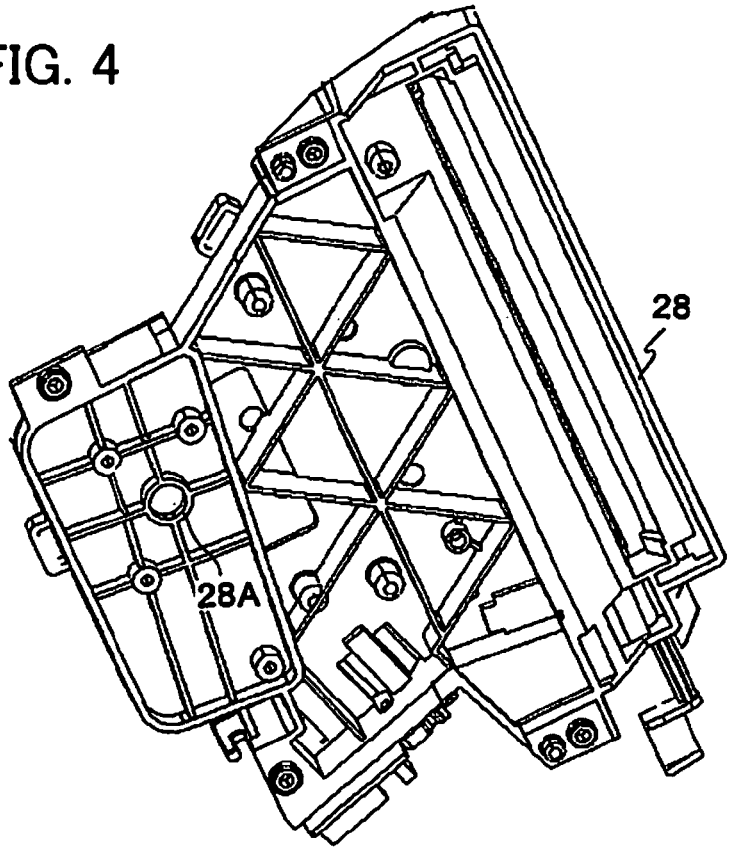
FIG. 4 is a perspective view of a housing of the optical scanning apparatus according to the first embodiment seen from below.
Figure 5:
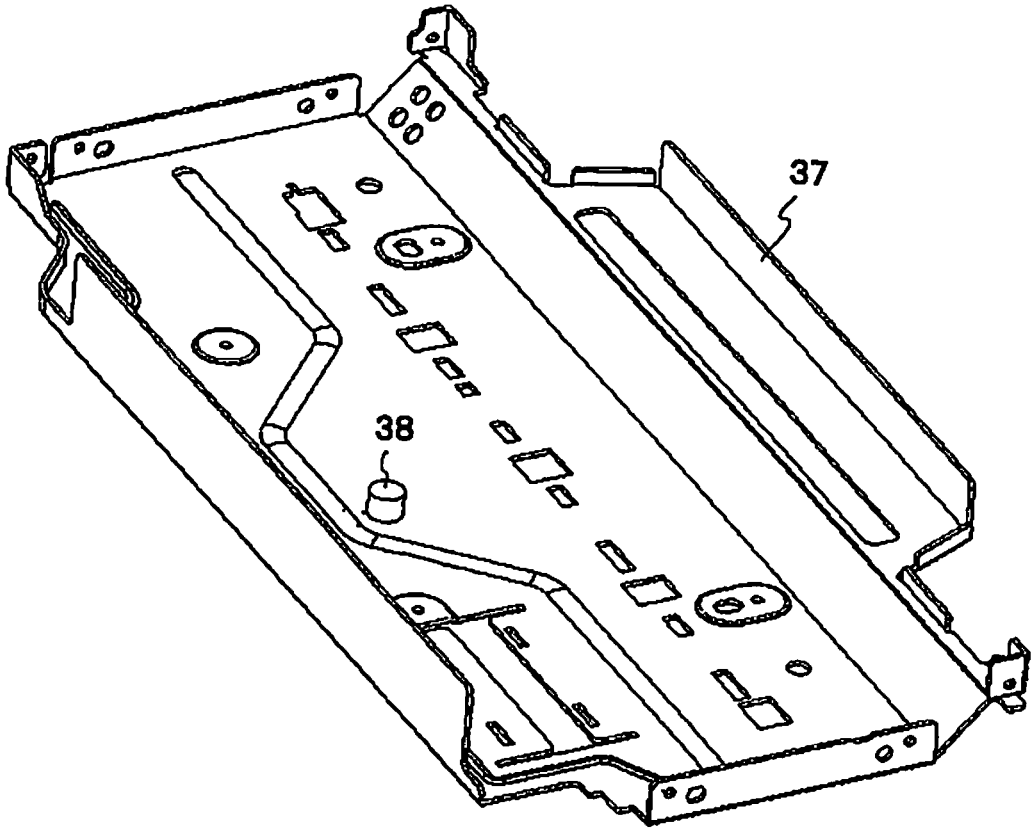
FIG. 5 is a perspective view of a metal frame of the image forming apparatus according to the first embodiment.

FIG. 2 is a plan view showing the optical scanning apparatus according to the first embodiment of the present invention, in a state in which a cover thereof is removed. FIG. 3 is a cross-sectional side view of the optical scanning apparatus. FIG. 4 is a perspective view of a housing of the optical scanning apparatus seen from below. FIG. 5 is a perspective view of a metal frame of the laser printer.

As shown in FIG. 2, in the optical scanning apparatus 21 according to the first embodiment of the present invention, a laser diode 29 being a light source is attached to a housing 28 made of resin. Moreover, for example, a cylindrical lens 30, a polygon mirror (rotating polygon mirror) 31 as a deflection means, a polygon motor (drive motor) 32 that rotationally drives the polygon mirror 31, fθ lenses 33 and 34 that are scanning lenses, and a reflection mirror 35 are accommodated inside the housing 28. As shown in FIG. 3, a top opening of the housing 28 is covered with a cover 36 made of resin.

As shown in FIG. 3, the optical scanning apparatus 21 having the aforementioned configuration is positioned and attached to a metal frame 37 of the laser printer 1 shown in FIG. 1. As shown in FIG. 4, a cylindrical positioning boss 28A is formed on a bottom face of the housing 28. In addition, as shown in FIG. 5, as a positioning member, a metal positioning pin 38 is provided upright to a point corresponding to the positioning boss 28A in the metal frame 37.

Incidentally, in the first embodiment, as shown in FIG. 3, a bearing 39 of the polygon motor 32 and the metal positioning pin 38 provided upright to the metal frame 37 are inserted into and fitted with each other in opposite directions in the positioning boss 28A formed in the housing 28. In other words, the bearing 39 of the polygon motor 32 is fitted by being inserted from above, and the positioning pin 38 is fitted by being inserted from below. A cushioning material 40 as a buffer material made of Si system resin, etc. having high thermal conductivity is interposed between the bearing 39 and the positioning pin 38.

Therefore, inside the positioning boss 28A formed in the housing 28, the bearing 39 of the polygon motor 32 is in contact with the positioning pin 38 via the cushioning material 40 having high thermal conductivity.

In this way, in the optical scanning apparatus 21 configured as above, as shown in FIGS. 2 and 3, the laser beam L emitted from the laser diode 29 being a light source passes the cylindrical lens 30 having an index of refraction only in a single direction, and is condensed linearly on a reflection surface of the polygon mirror 31.

The polygon mirror 31 is rotationally driven at high speed by way of the polygon motor 32. The laser beam L condensed on the reflection surface of the polygon mirror 32 is deflected and scanned by way of revolution of the polygon mirror 32, and passes the two fθ lenses 33 and 34. Subsequently, the laser beam L is reflected by way of the reflection mirror 35, and is imaged as a minute spot on the surface of the photoreceptor drum 16 shown in FIG. 1. As a result, an electrostatic latent image corresponding to the image information is formed on the surface of the photoreceptor drum 16. Thereafter, as described above, the electrostatic latent image is visualized (developed) as a toner image by way of the developing device 18.

In the above, the heat generated in the polygon motor 32 of the optical scanning apparatus 21 is conducted from the bearing 39 of the polygon motor 32 to the metal positioning pin 38 via the cushioning material 40 having high thermal conductivity. The heat is then radiated from the positioning pin 38 to the outside of the housing 28. The positioning pin 38 functions as a heat sink. In this way, according to the first embodiment, the increase of the ambient temperature inside the housing 28 can be suppressed with a simple configuration using existing parts. Accordingly, deterioration of image quality accompanying deviation or the like of a focal length due to thermal deformation of the polygon mirror 31 can be prevented without causing upsizing or cost increase of the optical scanning apparatus 21. Therefore, high quality images can be stably obtained in the laser printer 1 shown in FIG. 1.

Moreover, in the first embodiment, the bearing 39 of the polygon motor 32 is in contact with the positioning pin 38 via the cushioning material 40 having high thermal conductivity. Therefore, variability of the height dimension of the positioning pin 38 is absorbed by elastic deformation of the cushioning material 40, and an effect of improving the productivity and mountability is also provided.

It should be noted that the above description has been provided for the embodiment in which the first aspect of the present invention is applied to a laser printer and an optical scanning apparatus provided thereto. However, the first aspect of the present invention can be similarly applied to any other image forming apparatus including a copying machine, a facsimile, etc. other than a printer, and to an optical scanning apparatus provided thereto.

Next, a second embodiment according to a second aspect of the present invention is described with reference to the drawings.

Figure 6:
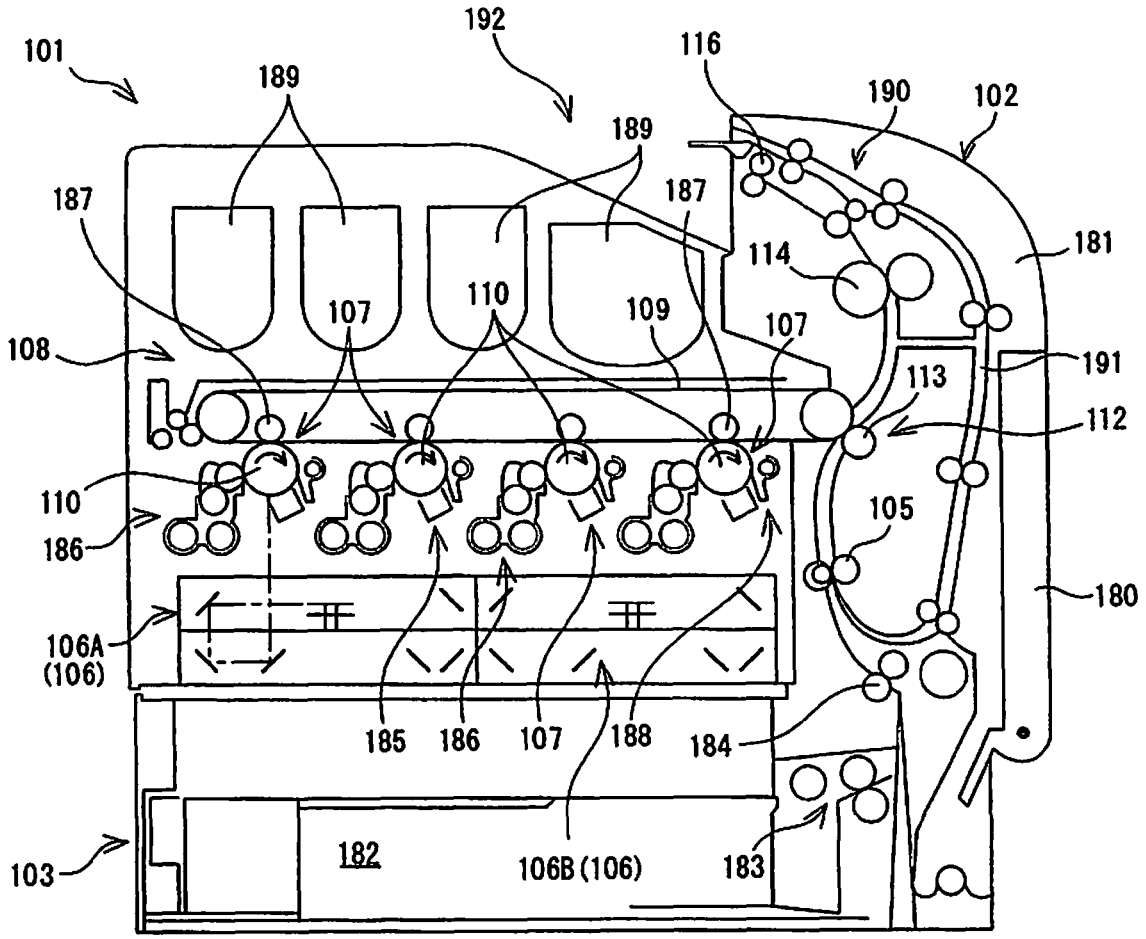
FIG. 6 is a configuration diagram of a printer according to a second embodiment of the present invention.

FIG. 6 is a configuration diagram of a color printer that is the second embodiment. The cross section shown in FIG. 6 is a diagram seen from a left side face of a printer 101. Accordingly, a front face of the printer 101 is positioned on a right side of FIG. 6, and a rear face of the printer 101 is positioned on a left side of FIG. 6. The printer 101 includes an apparatus main body (image forming apparatus main body) 102. An ejected paper tray 192 is provided in an upper portion of the apparatus main body 102. In the vicinity of the ejected paper tray 192, a front cover 181 is provided, which is disposed with a plurality of operation keys used for a variety of operations by a user, and a screen that displays a variety of information.

A paper feed cassette 103 is disposed in a lower portion of the apparatus main body 102. Paper (recording material) before image formation is accommodated in a stacked state in an accommodating portion 182 of the paper feed cassette 103. The paper is separated sheet by sheet to be delivered into the apparatus main body 102.

Specifically, a feed roller 183 is provided at a top right corner of the accommodating portion 182 in FIG. 6. The paper is delivered toward the top right corner of the paper feed cassette 103. The delivered paper is conveyed upward along the front face of the printer 101, inside the apparatus main body 102. It should be noted that the paper feed cassette 103 is configured to be withdrawable toward the front face side of the printer 1, i.e. toward the right direction in FIG. 6. In the withdrawn state, new paper can be refilled into the accommodating portion 182, and the paper can be replaced with another type of paper.

A conveyance roller 184, a resisting roller 105, an image forming unit 108, and a transfer unit 112 are disposed in this order in a paper conveying direction inside the apparatus main body 102. Four drum units 107 are arranged in parallel in the image forming unit 108 of the second embodiment. A photoconductor drum (image carrying body) 110 that carries a visible image (toner image) of each corresponding color is provided to each of the drum units 107 (see FIGS. 6 and 7).

Each drum 110 is rotatably disposed, and is each driven clockwise in FIG. 6 by way of a drive motor (polygon motor) that is not illustrated.

An exposure device (optical scanning apparatus) 106 is provided below the image forming unit 108, i.e. between the photoconductor drum 110 and the paper feed cassette 103. Laser beams corresponding to, for example, four different color toners of yellow, magenta, cyan and black are irradiated toward the photoconductor drums 110 from the exposure devices 106, respectively. In addition, as shown in FIG. 6, a charging device 185, a developing device 186, an intermediate transfer roller 187, and a cleaning unit 188 are provided to predetermined positions, respectively, around each drum 110.

The charging device 185 is positioned in a lower portion of each of the photoconductor drums 110, and uniformly charges a surface of each drum 110. Moreover, in FIG. 6, the developing device 186 is each disposed on the left side of each drum 110. The intermediate transfer belt 109 is disposed above each drum 110. Four toner containers 189 are disposed between the transfer belt 109 and the ejected paper tray 192. The containers 189 for yellow, magenta, cyan and black, respectively, are disposed in this order from the rear face side toward the front face side of the printer 101. A capacity of the container 189 for black is the largest among capacities of the four containers 189.

When a yellow toner, a magenta toner, a cyan toner and a black toner are electrostatically adhered on a surface of each photoconductor drum 110, a toner image corresponding to an electrostatic latent image is developed on the surface by way of the exposure device 106.

Toner images formed on the surfaces of the drums 110 are sequentially transferred onto the intermediate transfer belt 109 to be superimposed as a toner image for a single page. A transfer roller 113 is provided to the transfer unit 112. The transfer roller 113 is configured to be able to press and contact the transfer belt 109 from a diagonally lower direction thereof. When the paper passes between the transfer belt 109 and the transfer roller 113, the toner image superimposed on the transfer belt 109 is transferred onto the paper.

Moreover, a fixing unit 114, an ejection branch unit 190, and an ejection roller 116 are disposed in this order in the paper conveying direction on a downstream side of the transfer unit 112. The paper delivered from the fixing unit 114 is ejected to the ejected paper tray 192.

In the second embodiment, a paper path 191 for duplex printing is formed between the transfer unit 112 and a manual feed tray 180. The paper path 191 is branched from the ejection branch unit 190 on the front face side of the apparatus main body 102 to extend downward, and extends to an upstream side of the resisting roller 105.

Figure 8:
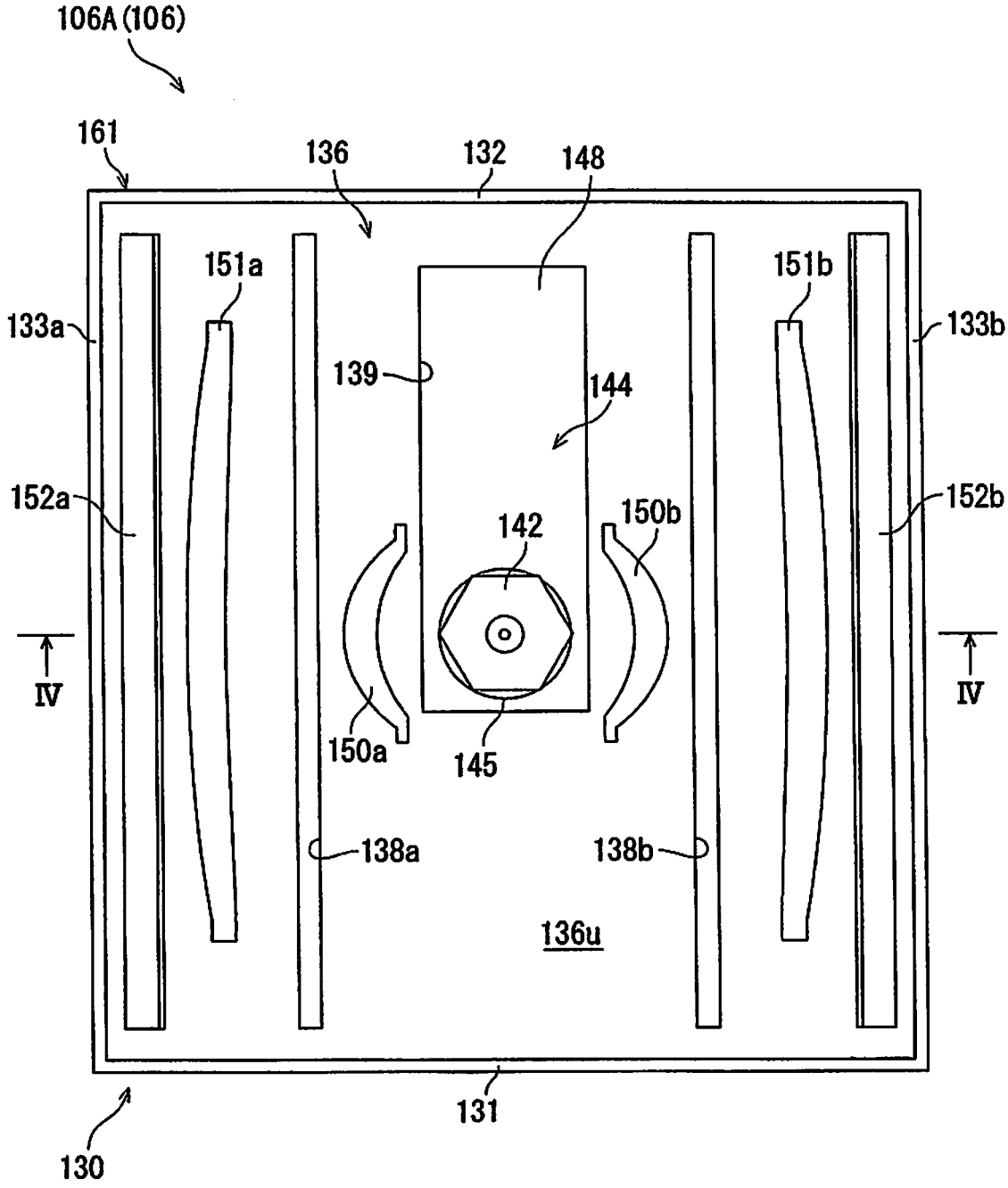
FIG. 8 is a plan view of an exposure device shown in FIG. 6.
Figure 9:
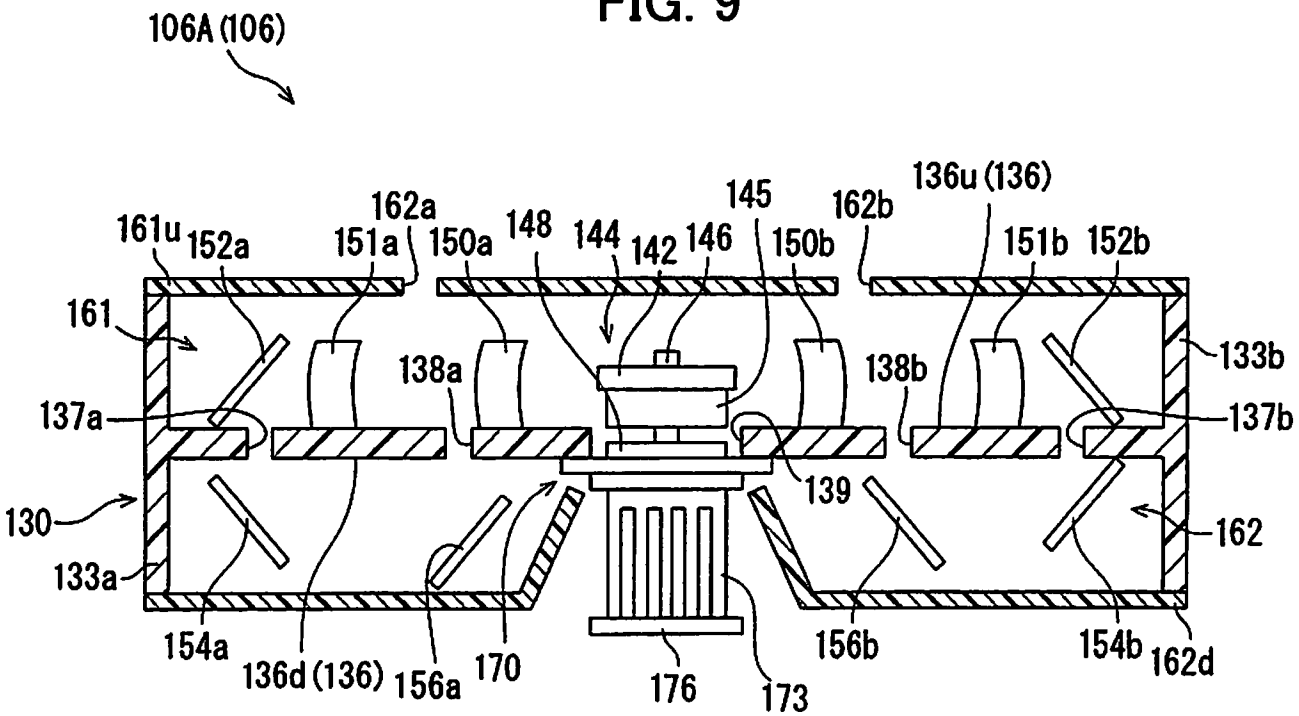
FIG. 9 is a cross-sectional view cut along a line IV-IV shown in FIG. 8.

Here, a variety of optical instruments are incorporated into the exposure device 106 of the second embodiment. More specifically, as shown in FIGS. 8 and 9, the exposure device 106 includes a box-shaped housing 130 made of resin. The housing 130 has a partition plate (plate-like partition portion) 136 that is substantially square-shaped in a plan view. Sides of the partition plate 136 are configured with four surrounding walls: a front face 131, a rear face 132, and side faces 133*a* and 133*b*, respectively.

The front face 131 and the rear face 132 face each other in a main scanning direction (rotational axis direction of the drum 110). The side faces 133*a* and 133*b* face each other in a sub scanning direction (conveying direction of paper).

As shown in FIG. 9, the housing 130 has covers 161*u* and 162*d*. It should be noted that illustration of the covers 161*u* and 162*d* is omitted from FIG. 8, in order to simplify the description of the structure inside the housing 130. One end of the front face 131, the rear face 132, and the side faces 133*a* and 133*b* abuts the cover 161*u*. Another end of the front face 131, the rear face 132, and the side faces 133*a* and 133*b* abuts the cover 162*d*. The cover 161*u* has slits 162*a* and 162*b* in predetermined positions.

Moreover, the exposure device 106 of the second embodiment is fixed to a metal portion of the apparatus main body 102 by way of screws (not shown) in a posture in which the cover 161*u* faces toward the photoconductor drum 110, and the cover 162*d* faces toward the paper feed cassette 103. The partition plate 136 is provided in a position, for example, which vertically partitions the inside of the housing 130.

Specifically, the partition plate 136 of the second embodiment lies in a substantially central portion in a height direction of the front face 131, the rear face 132 and the side face 133*a* and 133*b* (a structure like the shape of the letter H in a cross sectional view of FIG. 9), and extends substantially in parallel with the covers 161*u* and 162*d*.

The partition plate 136 partitions the inside of the housing 130 into a first level 161 and a second level 162. As shown in FIG. 9, the partition plate 136 has a high temperature side reference seating face 136*u* and a low temperature side reference seating face 136*d* (a face facing the second level).

More specifically, the first level 161 is space surrounded by the cover 161*u*, the front face 131, the rear face 132, the side faces 133*a* and 133*b* and the high temperature side reference seating face 136*u*. On the other hand, the second level 162 is space surrounded by the low temperature side reference seating face 136*d*, the front face 131, the rear face 132, the side faces 133*a* and 133*b* and the cover 162*d*.

In addition, optical instruments, which are configured with two light sources 140 (see FIG. 7), an optical deflector, an optical system and the like, are disposed in the housing 130 of the second embodiment.

In other words, an exposure device 106A (shown on the left side of FIG. 6) corresponding to images of, for example, yellow and magenta, and an exposure device 106B (shown in the right side of FIG. 6) corresponding to images of, for example, cyan and black, are separately disposed in the printer 101.

Here, the former exposure device 106A corresponding to images of yellow and magenta is described as an example.

The two light sources 140 (see FIG. 7) are disposed in parallel outside the housing 130 on the front face 131 side in the exposure device 106A. The two light sources 140 are composed of a laser diode (LD) for yellow, and an LD for magenta, respectively. A light beam in a visible spectrum is irradiated from each independent LD toward an optical deflector inside the housing 130.

The optical deflector is disposed on the first level 161, and is configured with a polygon mirror (rotating polygon mirror) 142 and a drive unit 144 (see FIG. 8). The polygon mirror 142 is shaped like a regular polygon in a planar view. Each side face of the polygon mirror 142 is formed with a plane mirror. Moreover, a central portion of the polygon mirror 142 is fixed to a motor shaft 146 (see FIG. 9). The drive unit 144 has a drive motor 145 that is connected to the motor shaft 146.

Figure 10:
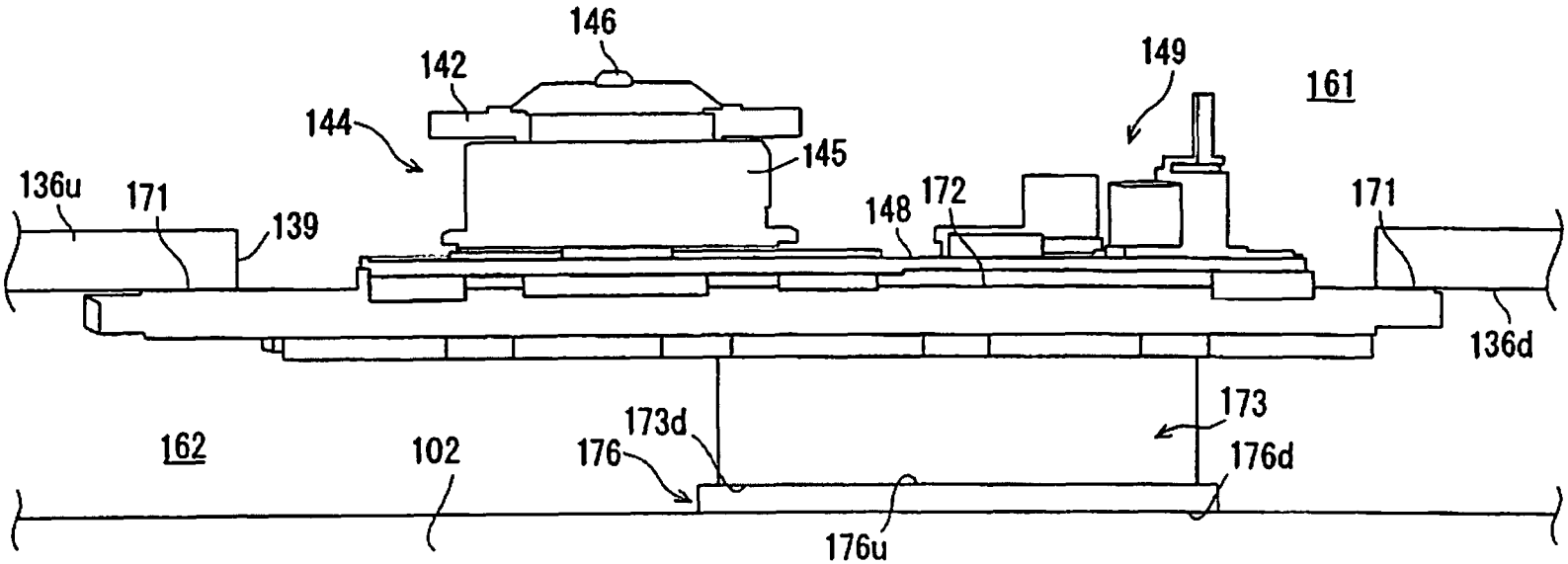
FIG. 10 is a diagram illustrating an installed state of a drive unit holding portion and a cushioning material shown in FIG. 9.

The motor 145, together with electrical components 149 such as an IC and a resistance, is mounted to a rectangular circuit board 148 (see FIG. 10). It should be noted that FIG. 10 is a view of the circuit board 148 in FIG. 9 seen from the side face 133*b* side.

The circuit board 148 is disposed from below the polygon mirror 142 toward the rear face 132, and is fixed to a drive unit holding portion (holding member) 170 made of metal (for example, aluminum) to be described later.

In addition, an opening 139 is formed in the partition plate 136 (see FIGS. 8 to 10). The opening 139 penetrates the partition plate 136 in a thickness direction thereof, and extends from the vicinity of the center of the partition plate 136 toward the rear face 132. The circuit board 148 placed on the drive unit holding portion 170, the drive motor 145, the polygon mirror 142 and the like mounted on the circuit board 148 protrude from the opening 139, and are disposed on the first level 161.

The aforementioned optical system is disposed in an area through which a laser beam reflected from the polygon mirror 142 travels. In the second embodiment, the aforementioned optical system is configured with fθ lenses 150*a* and 150*b* for yellow and for magenta, respectively, fθ lenses 151*a* and 151*b* for yellow and for magenta, respectively, and six planar reflection mirrors 152*a*, 152*b*, 154*a*, 154*b*, 156*a* and 156*b*.

The fθ lenses 150*a* and 150*b* for yellow and for magenta, respectively, are provided on the first level 161, and are disposed along the sub scanning direction while interposing the polygon mirror 142. For example, the fθ lens 150*a* for yellow is disposed on the left side of the polygon mirror 142 in FIGS. 8 and 9. The fθ lens 150*b* for magenta is disposed on the right side of the polygon mirror 142.

Next, the fθ lens 151*a* for yellow is disposed on the left side of the lens fθ 150*a* in FIGS. 8 and 9. The fθ lens 151*b* for magenta is disposed on the right side of the fθ lens 150*b*. The fθ lenses 151*a* and 151*b* are also provided on the first level 161.

Furthermore, as shown in FIG. 9, the reflection mirrors 152*a*, 154*a* and 156*a* for yellow are provided on the left side while interposing the polygon mirror 142.

First of all, the reflection mirror 152*a* is disposed in the vicinity of a portion where the side face 133*a* and the high temperature side reference seating face 136*u* intersect, i.e. on the first level 161. Both ends of the reflection mirror 152*a* are supported by way of a mirror support member made of resin (not shown) formed on the reference seating face 136*u*. As a result, the reflection mirror 152*a* is tilted at a predetermined angle, and is disposed along the main scanning direction.

On the other hand, the reflection mirrors 154*a* and 156*a* are provided on the second level 162.

More specifically, the reflection mirror 154*a* is disposed underneath the reflection mirror 152*a* while interposing the partition plate 136. The reflection mirror 156*a* is disposed underneath the fθ lens 150*a* for yellow. Both ends each of the reflection mirrors 154*a* and 156*a* are supported by way of a mirror support member made of resin (not shown) formed on the low temperature side reference seating face 136*d*. As a result, the reflection mirror 154*a* and 156*a* are tilted at a predetermined angle, and are disposed along the main scanning direction.

In this way, in the second embodiment, the polygon mirror 142, the fθ lenses 150*a* and 151*a*, and the reflection mirror 152*a* are provided on the first level 161. On the other hand, the reflection mirrors 154*a* and 156*a* are provided on the second level 162. In addition, the exposure device 106A is positioned underneath each photoconductor drum 110. A slit (aperture) 137*a* and a slit 138*a* are formed in the partition plate 136.

More specifically, as shown in FIG. 9, the slit 137*a* is formed by penetrating the high temperature side reference seating face 136*u* and the low temperature side reference seating face 136*d* in a position for guiding the scanning light from the reflection mirror 152*a* to the reflection mirror 154*a*. Moreover, the slit 138*a* is formed by penetrating the high temperature side reference seating face 136*u* and the low temperature side reference seating face 136*d* in a position for guiding the scanning light from the reflection mirror 156*a* to the photoconductor drum 110.

Accordingly, the slit 138*a* in the second embodiment is formed between the fθ lens 150*a* and the fθ lens 151*a* on the left side of the polygon mirror 142 in the partition plate 136 in FIG. 9. The two slits 137*a* and 138*a* for yellow each extend along the main scanning direction similarly to the disposition direction of the reflection mirrors 152*a*, 154*a* and 156*a*.

The reflection mirrors 152*b*, 154*b* and 156*b* for magenta are disposed on the right side of the polygon mirror 142 in FIGS. 8 and 9, and are provided in positions that are substantially similar to the positions of the reflection mirrors 152*a*, 154*a* and 156*a* for yellow. Furthermore, in the partition plate 136 as well, two slits (apertures) 137*b* and 138*b* for magenta are formed in positions that are substantially similar to the positions of the slits 137*b* and 138*b* for yellow.

In addition, when each light source 140 such as for yellow and for magenta radiates a laser beam based on a signal from a controller 120 (see FIG. 7) provided inside the apparatus main body 102, each laser beam correspondingly passes through a collimator lens, a prism, a cylindrical lens and the like, and travels toward the polygon mirror 142.

Similarly, when the motor shaft 146 revolves at high speed by receiving mechanical power from the drive motor 145 based on a signal from the controller 120, the polygon mirror 142 revolves at high speed.

Each laser beam such as of yellow and of magenta is incident on the polygon mirror 142 in a state of being deviated for a minute angle. Subsequently, the polygon mirror 142 thus revolving deflects and outputs each laser beam toward each of the side faces 133*a* and 133*b*.

Each laser beam reflected on the polygon mirror 142 is deflected at uniform velocity by way of the corresponding fθ lenses 150*a*, 150*b*, 151*a* and 151*b*.

The laser beam that passed each of the fθ lenses 150*a*, 150*b*, 151*a* and 151*b* is each reflected downward by way of the reflection mirrors 152*a* and 152*b*, further passes through the slits 137*a* and 137*b* of the partition plate 136, and reaches the second level 162.

Subsequently, each laser beam is reflected toward the inside of the housing 130 by way of the reflection mirrors 154*a* and 154*b*. Thereafter, each laser beam is reflected upward again by way of the reflection mirrors 156*a* and 156*b*, passes through the slits 138*a* and 138*b* of the partition plate 136 and the slits 162*a* and 162*b* of the cover 161*u*, and reaches the surface of the drum 110 for yellow or the surface of the drum 110 for magenta.

Moreover, regarding the exposure device 106B corresponding to a cyan image and a black image as well, based on a signal from the controller 120, a laser beam of each light source 140 reaches the surface of the drum 110 for cyan or the surface of the drum 110 for black, via the polygon mirror 142, the corresponding fθ lenses 150*a*, 150*b*, 151*a* and 151*b* and the reflection mirror 152*a*, 152*b*, 154*a*, 154*b*, 156*a* and 156*b*.

Incidentally, each second level 162 of the exposure devices 106A and 106B of the second embodiment is provided with the drive unit holding portion 170.

Figure 11:
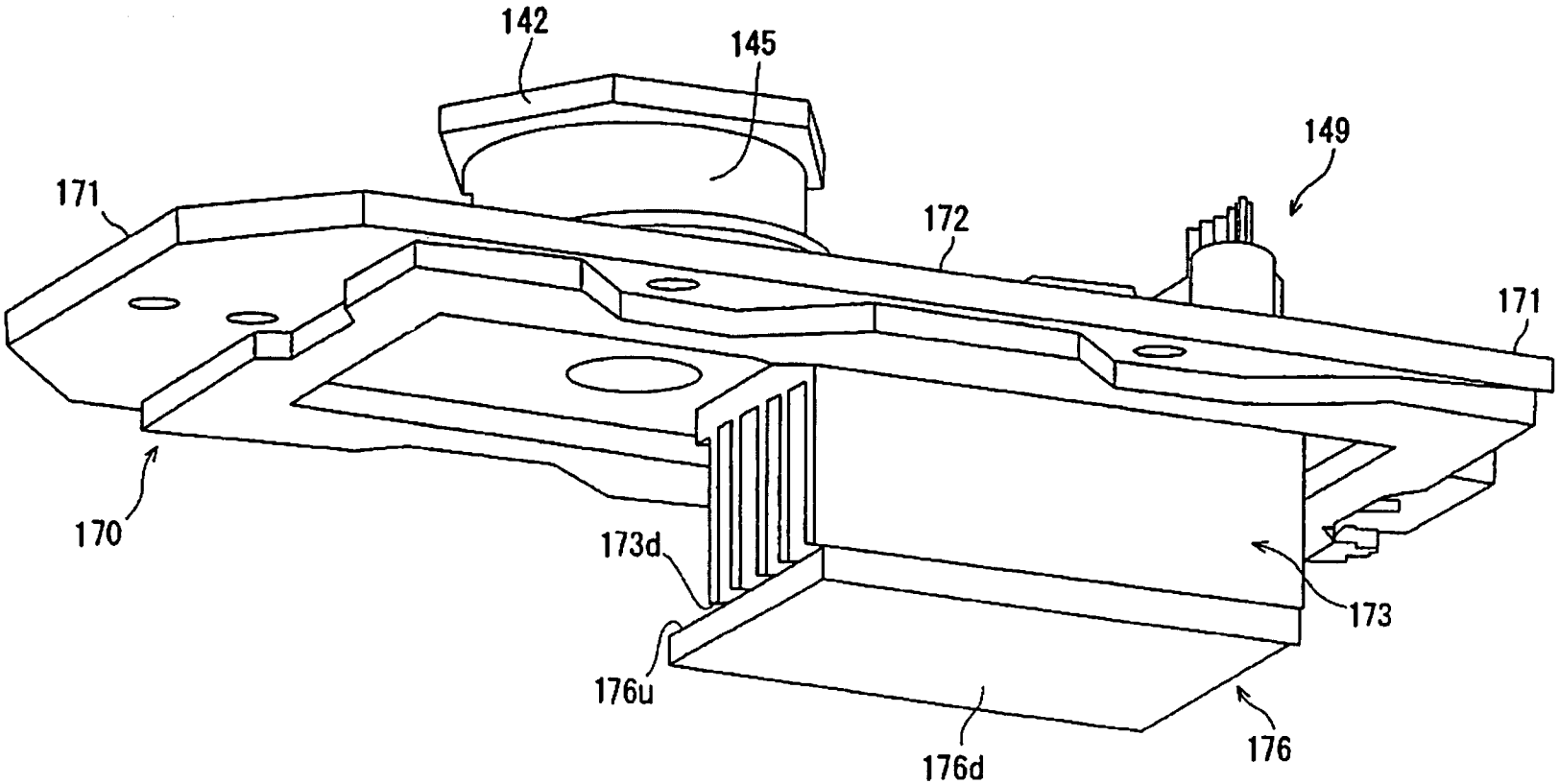
FIG. 11 is an enlarged perspective view of the drive unit holding portion and the cushioning material shown in FIG. 9.

Specifically, as shown in FIGS. 10 and 11, the drive unit holding portion 170 has a unit resting surface 172 that supports a total weight of the drive unit 144, and is configured with a wide area on which the periphery of the circuit board 148 can be placed. More specifically, the total weight of the drive unit 144 is a total weight of the drive motor 145, the polygon mirror 142, the electrical components 149, etc. that are mounted on the aforementioned circuit board 148.

As a result, the drive unit holding portion 170 can hold the entirety of the drive unit 144, and in other words, can hold the horizontal posture of the drive unit 144.

Furthermore, a partition plate support face 171 is formed on the outer side of the unit resting surface 172. The partition plate support face 171 abuts the low temperature side reference seating face 136*d* on the outer side of the opening 139 (see FIG. 10). As a result, the opening 139 is closed by way of the drive unit holding portion 170. The polygon mirror 142, etc. protrude upward from the opening 139, and are disposed on the first level 161.

On the other hand, a radiating fin 173 is placed on the opposite side of the unit resting surface 172 in the drive unit holding portion 170.

The radiating fin 173 extends along the main scanning direction similarly to the disposition direction of the slits 137*a* and 138*a* and the reflection mirrors 152*a*, 154*a* and 156*a* and the like (FIGS. 10 and 11). The radiating fin 173 is provided to a position corresponding to a position in the first level 161 extending from the polygon mirror 142 to the electrical components 149.

Moreover, a portion facing the radiating fin 173 is opened in the cover 162*d*. The radiating fin 173 is exposed to the outside of the housing 130 (see FIG. 9), and is configured to be able to directly contact the air inside the apparatus main body 102.

Furthermore, the bottom side of the drive unit holding portion 170 (a bottom edge 173*d* of the radiating fin 173 in the present embodiment) is connected to a plate-like cushioning material (buffer material) 176 (FIGS. 10 and 11).

The cushioning material 176 of the second embodiment is, for example, a silicon gel sheet made of the Si system resin, etc. Thermal conductivity of the cushioning material 176 is high, and is, for example, 2.8 W/m·k.

In addition, the cushioning material 176 of the second embodiment is configured with a wide area on which the periphery of the radiating fin 173 can be placed. A top surface 176*u* of the cushioning material 176 is in contact with the entirety of the bottom edge 173*d* of the radiating fin 173.

By this, the cushioning material 176 supports a total weight of the drive unit holding portion 170. More specifically, the total weight of the drive unit holding portion 170 is a weight of the drive unit 144 including the circuit board 148, the drive motor 145, the polygon mirror 142, the electrical components 149, etc., plus a weight of the radiating fin 173, etc. The cushioning material 176 can hold the entirety of the drive unit 144 and the drive unit holding portion 170, and in other words, can maintain the horizontal posture of the drive unit 144 and the drive unit holding portion 170.

On the other hand, a bottom face 176*d* of the cushioning material 176 abuts a metal portion of the aforementioned apparatus main body 102 (see FIG. 10).

In other words, when equipping the exposure devices 106A and 106B to the apparatus main body 102, the cushioning material 176 is interposed between the radiating fin 173 exposed to the outside of the housing 130 and the metal portion of the apparatus main body 102, and thereafter, the exposure devices 106A and 106B are fixed to the apparatus main body 102.

With reference to FIG. 6 again, when the printer 101 including the exposure devices 106A and 106B performs printing, paper is separated and delivered sheet by sheet from the paper feed cassette 103 by way of the feed roller 183. The paper passes the conveyance roller 184, and reaches the resisting roller 105. The resisting roller 105 delivers the paper toward the transfer unit 112, while correcting diagonal feed of the paper, and while timing the image transfer and the toner image formation in the image forming unit 108.

Figure 7:
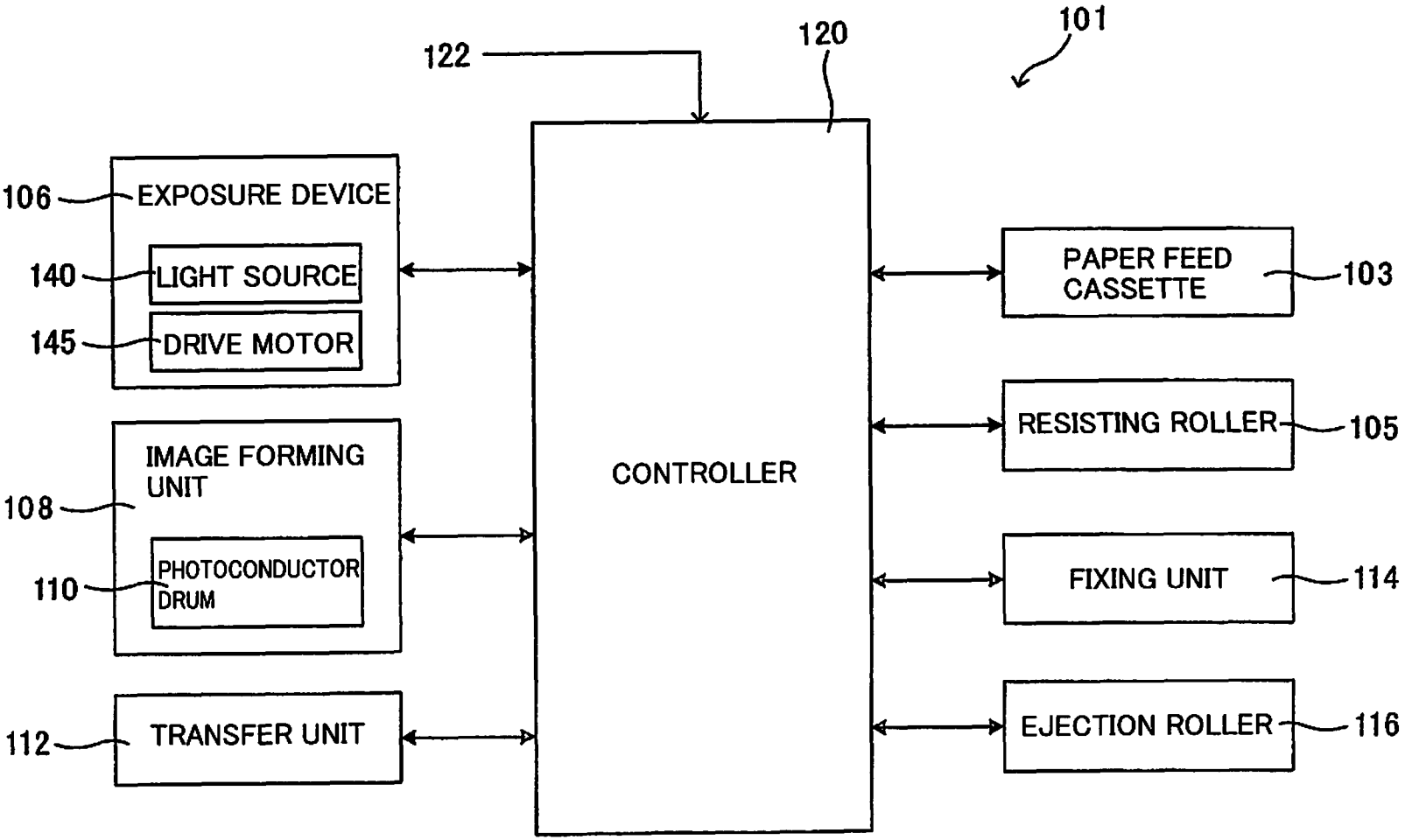
FIG. 7 is a configuration diagram of the printer according to the second embodiment shown in FIG. 6.

On the other hand, an input port 122 shown in FIG. 7 is configured to be able to receive image data serving as a basis of printing from outside. The image data is a result of conversion into data from a variety of images such as characters, symbols, graphics, signs, diagrammatic drawings and patterns. In addition, based on the data, the controller 120 controls laser beam radiation, etc.

Specifically, for each of the photoconductor drums 110, the charging device 185 charges the surface of the drum 110, and the exposure device 106 irradiates a laser beam onto the surface of the drum 110. As a result, an electrostatic latent image is formed on a surface of each drum 110, and a toner image of each color is formed from the electrostatic latent image.

Each toner image is transferred via the transfer belt 109 onto paper in the transfer unit 112. It should be noted that a toner remaining on each surface of the photoconductor drums 110 is removed by way of the cleaning unit 188.

Subsequently, the paper in a state of carrying an unfixed toner image is delivered toward the fixing unit 114, and is heated and pressurized in the fixing unit 114. The toner image is then fixed to the paper. Next, the paper delivered from the fixing unit 114 is ejected to the ejected paper tray 192 by way of the ejection roller 116.

When performing duplex printing, the conveying direction of the paper ejected from the fixing unit 114 is switched in the ejection branch unit 190. In other words, the paper with one side printed is pulled back to the inside of the apparatus main body 102, and is conveyed to the paper path 191 for duplex printing. Subsequently, the paper is delivered to the upstream side of the resisting roller 105, and is delivered toward the transfer unit 112 again. As a result, a toner image is transferred onto another surface of the paper, on which printing is not performed yet.

As descried above, according to the second embodiment, the drive unit 144 is provided inside the housing 130, and the drive unit 144 has the polygon mirror 142, the drive motor 145, the circuit board 148, etc.

The polygon mirror 142 is driven by revolution of the motor shaft 146. In addition, vibration occurs with the revolution of the motor shaft 146. The vibration is easily transmitted from the partition plate 136 including the slits 137*a* and 137*b*, etc. to the mirror support member made of resin in the reflection mirrors 152*a* and 152*b*, etc. Therefore, there is a concern that a position of writing an image by scanning light is not stabilized (generation of a jitter image).

However, in the second embodiment, the drive unit holding portion 170 made of aluminum maintains the horizontal posture of the drive unit 144 having the polygon mirror 142, the drive motor 145, the circuit board 148, etc. In other words, the drive unit holding portion 170 has a wide area that can support the total weight of the drive unit 144. In addition, the plate-like cushioning material 176 maintains the horizontal posture of the drive unit holding portion 170. In other words, the cushioning material 176 has a wide area that can support the total weight of the drive unit holding portion 170 including the weight of the drive unit 144 as well.

Therefore, according to the second embodiment, vibration of the partition plate 136 can be immediately suppressed, and image deterioration due to a jitter image can be prevented, as compared to a conventional case in which a support portion is provided between slits, and an optical system is placed in the support portion to secure strength of a housing.

Furthermore, since the cushioning material 176 having a large area has high thermal conductivity, heat generated in the drive unit 144 can be instantly released to the apparatus main body 102, i.e. to the outside of the housing 130. Therefore, according to the second embodiment, it is not necessary as in conventional cases to select a material (coefficient of thermal expansion) of a housing, which is close to a coefficient of thermal expansion of an apparatus main body. Moreover, according to the second embodiment, thermal deformation of the housing can be securely avoided, and image deterioration due to generation of color deviation in an image can also be prevented, as compared to a case of cooling the housing with merely cooling air from a blower.

In addition, according to the second embodiment, the drive unit holding portion 170 includes the radiating fin 173, and the radiating fin 173 can assist the heat radiation function by way of the cushioning material 176; therefore, an ambient temperature inside the housing 130 can be decreased even more effectively.

Furthermore, according to the second embodiment, since the housing 130 has a structure like the shape of the letter H in a cross sectional view, it is possible to realize reduction of the size and height dimension of the exposure device 106. Moreover, the inside of the housing 130 is partitioned into the first level 161 and the second level 162 by way of the partition plate 136. In addition, the polygon mirror 142 placed in the drive unit holding portion 170 protrudes from the opening 139, and is disposed on the first level 161. The scanning light from the polygon mirror 142 travels toward the second level 162 via the reflection mirrors 152*a* and 152*b*, etc. disposed on the first level 161 and the slits 137*a* and 137*b*.

Here, when the partition plate 136 of the housing 130 includes the slits 137*a* and 137*b* and the opening 139, the strength of the housing 130 is decreased as compared to a case in which the partition plate 136 does not include the slits and the opening. However, the drive unit holding portion 170 supports the low temperature side reference seating face 136*d* in the partition plate 136. In other words, the drive unit holding portion 170 supports the total weight of the housing 130 including the reflection mirrors 152*a* and 152*b*, etc. in addition to the total weight of the drive unit 144. Therefore, according to the second embodiment, the strength of the housing 130 is improved, and vibration that would be transmitted from the drive unit 144 to the housing 130 can also be suppressed.

Furthermore, according to the second embodiment, image deterioration due to a jitter image and an image with colour deviation can be prevented, and satisfactory image quality can be obtained, whereby improving the reliability of the printer 101.

The second aspect of the present invention is not limited to the second embodiment described above, and various alterations thereof can be performed in a range that does not depart from the scope of claims.

For example, the two light sources 140 are provided to the exposure device 106 of the second embodiment. However, the exposure device 106 is not necessarily limited to such an embodiment, and four light sources 140 may be provided to one exposure device 106.

Moreover, the partition plate 136 of the second embodiment vertically partitions the housing 130. However, depending on the posture of the exposure device 106, the partition plate 136 can partition the housing 130 in various directions such as a horizontal direction.

Furthermore, in the second embodiment, the reflection mirrors 154*a*, 154*b*, 156*a* and 156*b* are disposed on the second level 162 as well.

However, the second level 162 may also not be provided with an optical system. The reason thereof is that, for example, in a case in which the photoconductor drum 110 is disposed underneath the exposure device 106, the scanning light from the first level 161 passes the slits 137*a* and 137*b*, reaches the second level 162, and directly reaches the photoconductor drum.

Furthermore, the housing in the second aspect of the present invention is not limited to a structure like the shape of the letter H in a cross sectional view. In other words, in a case in which the housing is configured solely with the first level, and the partition plate 136 corresponds to the bottom face of the housing, the holding member may support the bottom face of the housing from below the bottom face to the outside of the housing, and the silicon gel sheet may be interposed between the holding member and the apparatus main body 102.

Moreover, the second embodiment shows an example of a printer as an image forming apparatus. However, the image forming apparatus of the present invention can be applied to a copying machine, a facsimile, etc.

In addition, similarly to the above, in any of these cases, an effect is achieved of securely preventing both of a jitter image and an image with colour deviation from being generated.

What is claimed is:

1. An optical scanning apparatus that is positioned and fixed to a metal frame of an image forming apparatus, the optical scanning apparatus comprising:

a housing;

a rotating polygon mirror that is a deflection means accommodated inside the housing;

a drive motor, which is accommodated inside the housing, and which rotationally drives the rotating polygon mirror; and a positioning boss that is formed in the housing, wherein a bearing of the drive motor and a positioning member provided upright to the metal frame are inserted into and fitted with each other from opposite directions in the positioning boss, and the bearing is in contact with the positioning member, and wherein the positioning member is a metal positioning pin.

2. The optical scanning apparatus according to claim 1, wherein the bearing of the drive motor is in contact with the positioning pin via a buffer having high thermal conductivity.

3. An image forming apparatus comprising the optical scanning apparatus according to claim 2.

4. An optical scanning apparatus comprising:

a housing;

a drive unit attached inside the housing, the drive unit including a rotating polygon mirror that deflects and scans scanning light in a predetermined direction from a light source, a drive motor that rotationally drives the rotating polygon mirror via a motor shaft, and a circuit board;

a holding member that holds entirety of the drive unit; and a plate-like buffer with high thermal conductivity, wherein the holding member includes a radiating fin, which extends from the drive unit toward the buffer, and which is in contact with air outside the housing, and wherein the buffer is in contact with the radiating fin and an image forming apparatus main body.

5. The optical scanning apparatus according to claim 4, wherein the housing includes a plate-like partition portion that partitions an inside of a surrounding wall thereof into a first level and a second level, the partition portion having: an aperture that communicates the first level and the second level to form a light path; and an opening for disposing the rotating polygon mirror on the first level, in which an optical system can be disposed such that scanning light from the rotating polygon mirror is deflected from the first level to the aperture, and wherein the holding member supports a face facing the second level in the partition portions to close the opening, and disposes the rotating polygon mirror on the first level in this state.

6. An image forming apparatus comprising the optical scanning apparatus according to claim 4, wherein the scanning light deflected and scanned by way of the rotating polygon mirror is irradiated on a surface of an image carrying body to form an electrostatic latent image, and a toner image, which was developed from the electrostatic latent image with a toner, is transferred onto a recording material.

7. The optical scanning apparatus according to claim 2, wherein the buffer having high thermal conductivity comprises one made of a silicon gel.

8. The optical scanning apparatus according to claim 4, wherein the plate-like buffer with high thermal conductivity comprises a silicon gel sheet.

9. An optical scanning apparatus, comprising:

a housing;

a drive unit attached inside the housing, the drive unit including a rotating polygon mirror that deflects and scans scanning light in a predetermined direction from a light source, a drive motor that rotationally drives the rotating polygon mirror via a motor shaft, and a circuit board;

a holding member that holds entirety of the drive unit; and a plate-like buffer with high thermal conductivity, which is in contact with both of the holding member and an image forming apparatus main body, and which supports entirety of the holding member, wherein the housing includes a plate-like partition portion that partitions an inside of a surrounding wall thereof into a first level and a second level, the partition portion having: an aperture that communicates the first level and the second level to form a light path; and an opening for disposing the rotating polygon mirror on the first level, in which an optical system can be disposed such that scanning light from the rotating polygon mirror is deflected from the first level to the aperture, and wherein the holding member supports a face facing the second level in the partition portions to close the opening, and disposes the rotating polygon mirror on the first level in this state.

10. The optical scanning apparatus according to claim 9, wherein the plate-like buffer with high thermal conductivity comprises a silicon gel sheet.

11. The image forming apparatus comprising the optical scanning apparatus according to claim 9, wherein the scanning light deflected and scanned by way of the rotating polygon mirror is irradiated on a surface of an image carrying body to form an electrostatic latent image, and a toner image, which was developed from the electrostatic latent image with a toner, is transferred onto a recording material.

* * * * *